US010954104B2

(12) United States Patent
Park

(10) Patent No.: US 10,954,104 B2
(45) Date of Patent: Mar. 23, 2021

(54) CHAIN DEFECT MONITORING IN A PEOPLE CONVEYOR

(71) Applicant: Otis Elevator Company, Farmington, CT (US)

(72) Inventor: Chan-Jong Park, Vienna (AT)

(73) Assignee: OTIS ELEVATOR COMPANY, Farmington, CT (US)

( * ) Notice: Subject to any disclaimer, the term of this patent is extended or adjusted under 35 U.S.C. 154(b) by 0 days.

(21) Appl. No.: 16/411,812

(22) Filed: May 14, 2019

(65) Prior Publication Data

US 2019/0352140 A1 Nov. 21, 2019

(30) Foreign Application Priority Data

May 16, 2018 (EP) ..... 18172717

(51) Int. Cl.

| | |
|---|---|
| ***B66B 29/00*** | (2006.01) |
| ***B66B 23/00*** | (2006.01) |
| ***B66B 25/00*** | (2006.01) |
| ***B66B 23/02*** | (2006.01) |

(52) U.S. Cl.

CPC ..... *B66B 25/006* (2013.01); *B66B 23/024* (2013.01); *B66B 29/00* (2013.01)

(58) Field of Classification Search

None

See application file for complete search history.

(56) References Cited

U.S. PATENT DOCUMENTS

| | | | | |
|---|---|---|---|---|
| 4,664,247 | A * | 5/1987 | Wolf | H02P 29/0022 198/323 |
| 4,863,006 | A | 9/1989 | Kotkata et al. | |
| 5,291,131 | A | 3/1994 | Suzuki et al. | |
| 5,300,925 | A | 4/1994 | Depfenhart | |
| 5,316,121 | A | 5/1994 | Zaharia et al. | |
| 5,563,392 | A | 10/1996 | Brown | |
| 6,851,546 | B2 | 2/2005 | Lodge | |
| 6,997,302 | B2 * | 2/2006 | Fargo | B66B 23/02 198/323 |
| 8,285,494 | B2 | 10/2012 | Vozner | |
| 9,671,251 | B2 * | 6/2017 | Siraky | G01D 5/20 |

(Continued)

FOREIGN PATENT DOCUMENTS

| | | |
|---|---|---|
| CN | 103946133 A | 7/2014 |
| CN | 107021412 A | 8/2017 |

(Continued)

OTHER PUBLICATIONS

European Search Report for application EP 18172717.3, dated Nov. 21, 2018, 7 pages.

(Continued)

*Primary Examiner* — Kavel Singh

(74) *Attorney, Agent, or Firm* — Cantor Colburn LLP

(57) ABSTRACT

A people conveyor (1) comprises a band (12) of conveyance elements (13) connected to and driven by at least one drive chain (15, 27) comprising a plurality of chain links (34, 36). The people conveyor (1) further comprises at least one inductive sensor (40, 41) arranged laterally next to the at least one drive chain (15, 27) and configured for monitoring the chain links (34, 36) passing by the at least one inductive sensor (40, 41).

16 Claims, 4 Drawing Sheets

(56) References Cited

U.S. PATENT DOCUMENTS

| | | | | |
|---|---|---|---|---|
| 2003/0000798 | A1* | 1/2003 | Williams | B66B 25/00 198/321 |
| 2009/0266674 | A1* | 10/2009 | Mueller | G01D 18/008 198/322 |
| 2012/0103756 | A1 | 5/2012 | Braasch et al. | |
| 2018/0339885 | A1* | 11/2018 | Park | F16H 7/06 |

FOREIGN PATENT DOCUMENTS

| | | | |
|---|---|---|---|
| EP | 1850087 | A1 | 10/2007 |
| EP | 2421787 | B1 | 7/2013 |
| GB | 2377918 | A | 1/2003 |
| JP | H02130402 | A | 5/1990 |
| JP | H11325829 | A | 11/1999 |
| JP | 2000291748 | A | 10/2000 |
| JP | 2002087750 | A | 3/2002 |
| JP | 4141649 | B2 | 8/2008 |

OTHER PUBLICATIONS

Frost, Inc., "Chain Wear Monitor", available at: https://www.frostinc.com/Chain-Wear-Monitor.html , accesed May 13, 2019, 4 pages.

Chinese Office Action for Application No. 201910409784.6; dated Apr. 7, 2020; 6 pages.

* cited by examiner

CHAIN DEFECT MONITORING IN A PEOPLE CONVEYOR

FOREIGN PRIORITY

This application claims priority to European Patent Application No. 18172717.3, filed May 16, 2018, and all the benefits accruing therefrom under 35 U.S.C. § 119, the contents of which in its entirety are herein incorporated by reference.

BACKGROUND

The invention relates to a method of monitoring chain defects in a people conveyor. The invention further relates to a people conveyor with a drive chain and at least one sensor configured for monitoring said drive chain.

People conveyors such as escalators and moving walkways comprise a band of conveyance elements, such as steps or pallets, moving in a conveyance direction. Said conveyance elements are connected with and driven by an endless conveyance chain acting as a drive chain. The conveyance chain may be a first drive chain which is driven by a motor via a second driven chain.

In order to avoid additional damage or severe safety issues resulting from operating the people conveyor with a damaged drive chain, it would be beneficial to be able to detect damages of the drive chain at an early stage.

SUMMARY

According to an exemplary embodiment of the invention, a people conveyor comprises a band of conveyance elements connected to and driven by at least one drive chain. The people conveyor further comprises at least one inductive sensor. The at least one inductive sensor is arranged laterally to the at least one drive chain and configured for monitoring the chain links of the at least one drive chain passing by.

A method of operating a people conveyor according to an exemplary embodiment of the invention includes monitoring the chain links of the at least one drive chain by means of the at least one inductive sensor, evaluating the detection signals provided by the at least one inductive sensor and issuing an alarm signal when a defect of the at least one drive chain is detected.

Exemplary embodiments of the invention allow detecting a defect of the at least one drive chain early and reliably. In consequence, appropriate countermeasures, such as stopping any further operation of the people conveyor, may be taken in order to avoid additional damage or severe safety issues which may result from operating the people conveyor with a damaged drive chain.

A number of optional features are set out in the following. These features may be realized in particular embodiments, alone or in combination with any of the other features.

A people conveyor according to an exemplary embodiment of the invention may comprise at least two inductive sensors. In particular at least one inductive sensor may be arranged on each lateral side of the at least one drive chain. Monitoring both sides of the at least one drive chain by a respectively assigned inductive sensor enhances the safety level of the detection.

The two inductive sensors may be arranged opposite to each other with the at least one drive chain extending in between the two inductive sensors. Such a configuration may facilitate the installation and maintenance of the sensors. For example, the two sensors may be attached to a common support.

As the two sensors work independently of each other, they not necessarily need to be located at the same position on opposite sides of the at least one drive chain.

In a people conveyor according to an exemplary embodiment of the invention, the at least one drive chain may extend over at least one sprocket, and the at least one inductive sensor may be arranged in the vicinity of said at least one sprocket. As the at least one drive chain is in engagement with and guided by the at least one sprocket, the amplitudes of oscillations of the drive chain are low in the vicinity of the at least one sprocket. Thus, in the vicinity of the at least one sprocket, the at least one drive chain passes by the at least one inductive sensor even when oscillating.

In order to ensure that the at least one drive chain passes by the at least one inductive sensor even when oscillating, the at least one inductive sensor may be arranged in a distance of not more than 50 cm from the sprocket, i.e. from the position at which the at least one drive chain engages with the sprocket. The at least one inductive sensor in particular may be arranged in a distance of not more than 25 cm from the sprocket, more particular in a distance of not more than 10 cm from the sprocket.

In order to ensure a reliable detection of a damaged drive chain, a people conveyor according to an exemplary embodiment of the invention may comprise an evaluation unit which is configured for receiving and evaluating the detection signals provided by the at least one inductive sensor in order to detect defects of the chain links of the at least one drive chain.

The evaluation unit may comprise a memory for storing at least one reference signal pattern representing intact (non-defective) chain links, and the evaluation unit may be configured for comparing the detection signals received from the at least one inductive sensor with the at least one stored reference signal pattern.

Comparing the detection signals received from the at least one inductive sensor with the at least one stored reference signal pattern may include identifying and comparing specific features of the signals. These features may include the shapes, in particular the widths and/or the heights (amplitudes), of peaks formed by the signals.

Comparing the detection signals received from the at least one inductive sensor with the at least one stored reference signal pattern allows for reliably detecting defects of the at least one drive chain.

The evaluation unit may be configured for issuing an alarm signal when a calculated difference between a detection signal received from the at least one inductive sensor and the at least one stored reference signal pattern exceeds a predetermined first threshold. The alarm signal may result in instructing a mechanic to visit the people conveyor in order to check and repair the damaged drive chain.

Further, the evaluation unit may be configured for stopping operation of the people conveyor, i.e. moving the at least one drive chain, in particular triggering a brake for braking the band of conveyance elements, when the calculated difference between a detection signal received from the at least one inductive sensor and the at least one stored reference signal pattern exceeds a predetermined second threshold.

The second threshold may be larger than the first threshold in order to stop further operation of the people conveyor only in case severe damage of the at least one drive chain has been detected.

Stopping operation of the people conveyor may be beneficial for preventing additional damage of the people conveyor and/or preventing the occurrence of severe safety issues resulting from the damage drive chain.

Triggering a brake for preventing any further movement of the conveyance elements in particular may be beneficial when the people conveyor is an escalator or an inclined moving walkway in which the band of conveyance elements may be driven by forces of gravity even after operation of a drive (motor) driving the people conveyor has been stopped.

The evaluation unit may be configured for performing at least one learning run in which detection signals received from the at least one inductive sensor are stored as reference signal patterns representing non-defective chain links within the memory. Performing at least one learning run allows conveniently generating reference signal patterns representing non-defective chain links which are perfectly tailored to the respective people conveyor.

The at least one drive chain monitored by the at least one sensor may include a conveyance chain (first drive chain) extending in the conveyance direction and being connected to the conveyance elements for driving the conveyance elements. The conveyance chain may be driven by a sprocket, which is driven by a people conveyor drive via transmission element.

Alternatively or additionally, the at least drive chain monitored by the at least one sensor may include a transmission element (second drive chain) extending between the people conveyor drive and the sprocket for driving the sprocket conveyance chain.

The sprocket may comprises two gear rims, a first gear rim engaging with the first drive chain (conveyance chain) and a second gear rim engaging with the second drive chain (transmission element). The first and second gear rims may have the same diameter/number of teeth, or the diameters/numbers of teeth may be different.

A people conveyor according to an exemplary embodiment of the invention may comprise two conveyance chains extending parallel to each other. At least one inductive sensor, which is configured for monitoring the chain links of the respective chain, may be arranged laterally next to each of the chains, respectively. In such a people conveyor, the driving forces are distributed between two conveyance chains and both conveyance chains may be monitored for detecting damage of each conveyance chain, respectively.

The people conveyor may be an escalator in which the conveyance elements are steps. Alternatively, the people conveyor may be a moving walkway in which the conveyance elements are pallets. In a moving walkway, the band of conveyance elements (pallets) may be inclined with respect to the horizontal, or it may extend horizontally.

DRAWING DESCRIPTION

In the following exemplary embodiments of the invention are described with reference to the enclosed figures.

DETAILED DESCRIPTION

Figure 1:
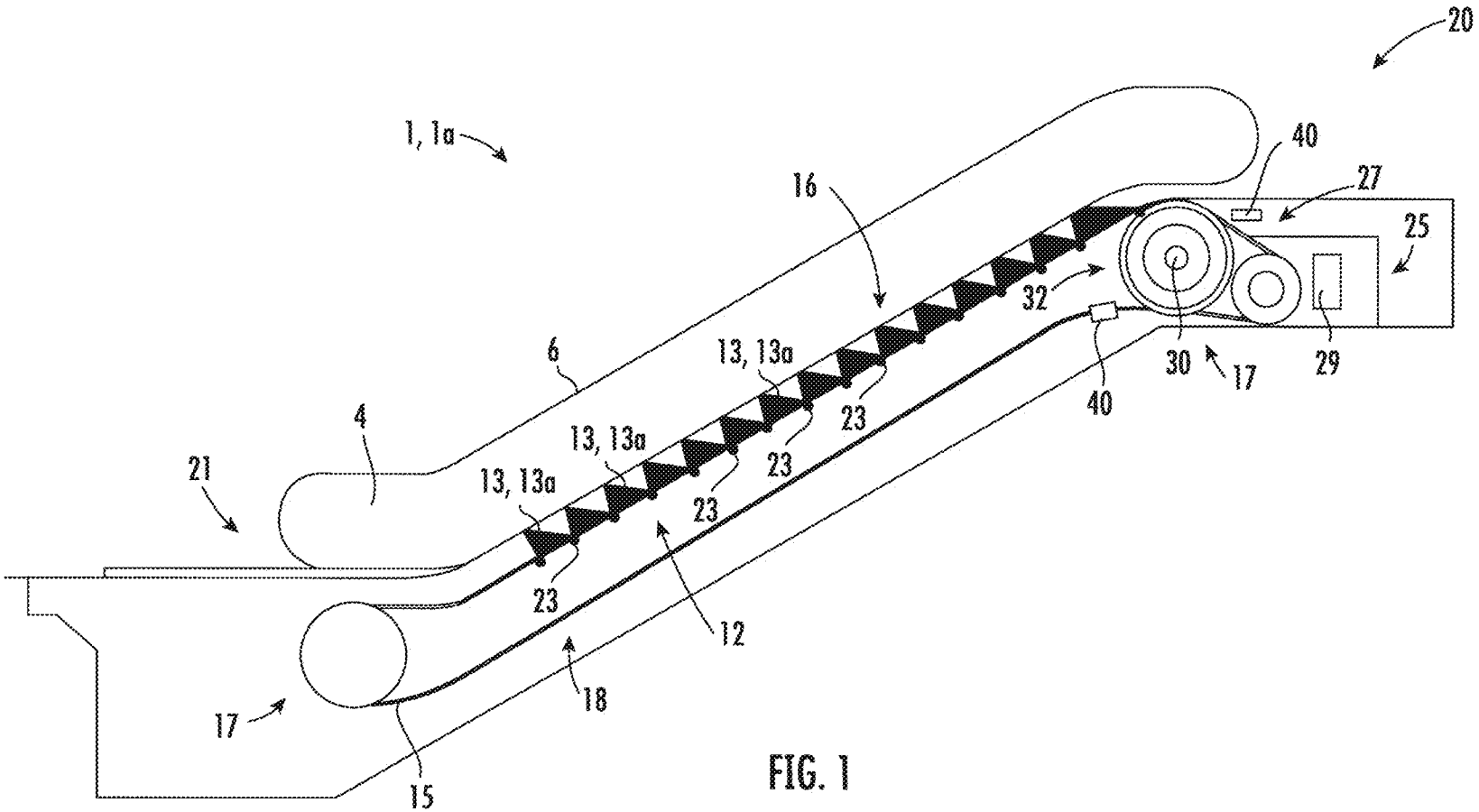
FIG. 1 depicts a schematic side view of an escalator.

FIG. 1 shows a schematic side view of a people conveyor 1, in particular an escalator 1*a*, comprising a band 12 of conveyance elements 13 (steps 13*a*) extending in a longitudinal conveyance direction between two landing portions 20, 21. The conveyance elements 13 comprise rollers 23 guided and supported by guide rails (not shown). For clarity, only some of the conveyance elements 13 are depicted in FIG. 1, and not all conveyance elements 13/rollers 23 are provided with reference signs.

In turnaround portions 17 next to the landing portions 20, 21, the band 12 of conveyance elements 13 passes from a conveyance portion 16 into a return portion 18, and vice versa. A conveyance chain 15 extending along a closed loop is connected to the band 12 of conveyance elements 13.

The conveyance chain 15 acts as a first drive chain 15 driving the band 12 of conveyance elements 13. The conveyance chain 15 is driven by a sprocket 32 mounted to a rotating shaft 30. A people conveyor drive 25 is configured for driving the rotating shaft 30 and in consequence the sprocket 32 and the conveyance chain 15 via a transmission element 27.

The transmission element 27 may be a second drive chain 27. In this case the sprocket 32 may comprise two gear rims, a first gear rim engaging with the first drive chain (conveyance chain) 15 and a second gear rim engaging with the second drive chain (transmission element) 27. The first and second gear rims may have the same diameter/number of teeth, or the diameters/numbers of teeth of the two gear rims may be different.

The people conveyor 1 further comprises a brake 29 for braking the band 12 of conveyance elements 13. In the embodiment depicted in FIG. 1, the brake 29 is integrated with the people conveyor drive 25 and configured for stopping the movement of the transmission element 27. In alternative configurations not depicted in the figures, the brake 29 may be configured for engaging with the sprocket 32, with the rotating shaft 30 or with the conveyance chain 15.

Balustrades 4 supporting moving handrails 6 extend parallel to the conveyance portion 16.

A sensor 40 configured for detecting damage of the conveyance chain 15 is arranged next to the conveyance chain 15, in particular in an area close to the sprocket 32.

Alternatively or additionally, a sensor 40 configured for detecting damage of the transmission element (second drive chain) 27 may be arranged next to the transmission element 27.

The functionality of said sensor 40 is described further below with reference to FIGS. 3 to 5.

Figure 2:
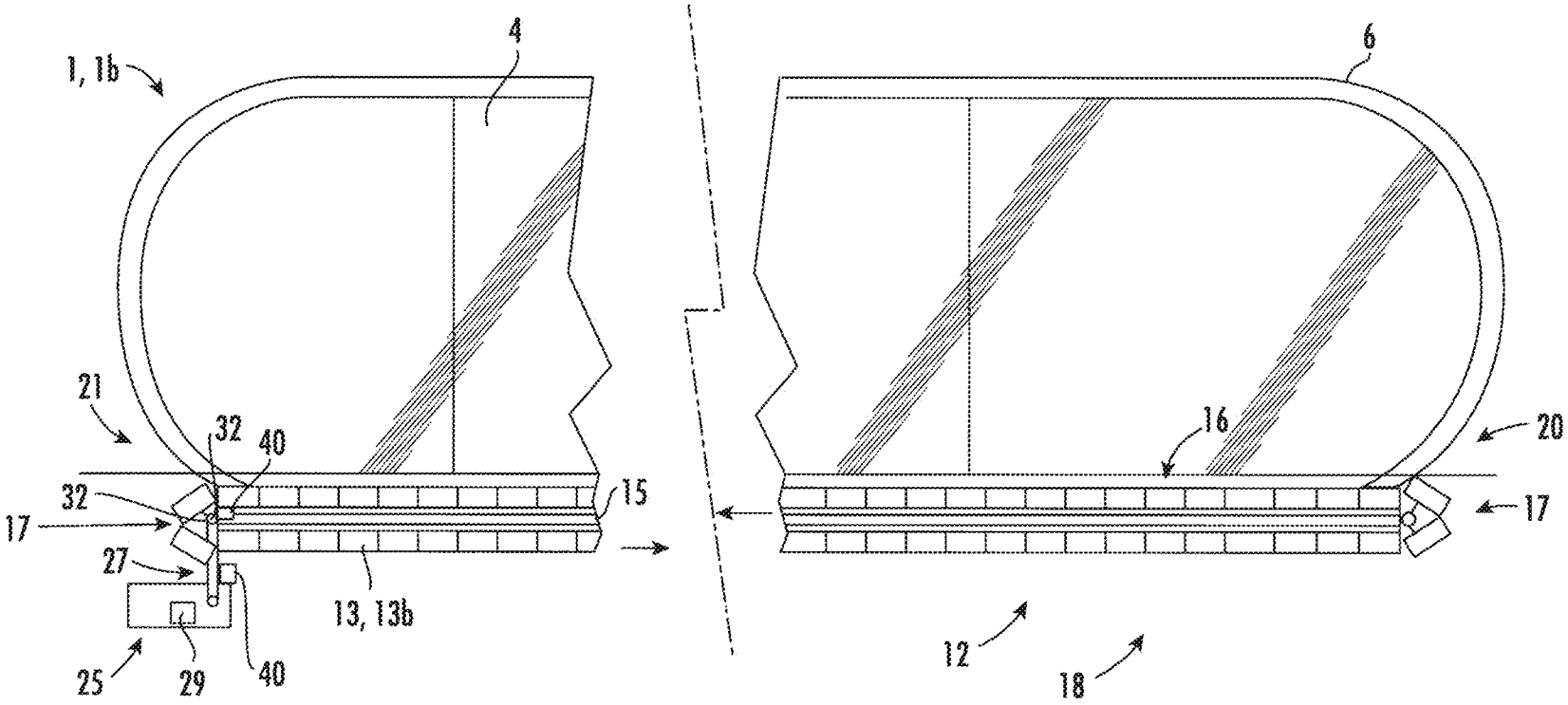
FIG. 2 depicts a schematic side view of a moving walkway.

FIG. 2 depicts a schematic side view of a people conveyor 1, which is provided as a moving walkway 1*b*.

The moving walkway 1*b* comprises an endless band 12 of conveyance elements 13 (pallets 13*b*) moving in a longitudinal conveyance direction in an upper conveyance portion 16 and opposite to the conveyance direction in a lower return portion 18. Landing portions 20, 21 are provided at both ends of the moving walkway 1. In turnaround portions 17 next to the landing portions 20, 21 the band 12 of conveyance elements 13 passes from the conveyance portion 16 into the return portion 18, and vice versa. Balustrades 4 supporting moving handrails 6 extend parallel to the conveyance portion 16.

Similar to the embodiment shown in FIG. 1, the band 12 of conveyance elements 13 is connected with an endless conveyance chain 15. In at least one of the turnaround portions 17, the endless conveyance chain 15 is in engagement with a sprocket 32. When the moving walkway 1*b* is operated, the sprocket 32 is driven by a people conveyor drive 25 via a transmission element 27 for driving the band 12 of conveyance elements 13.

The transmission element 27 may be a second drive chain 27. In this case the sprocket 32 may comprise two gear rims, a first gear rim engaging with the first drive chain (conveyance chain) 15 and a second gear rim engaging with the second drive chain (transmission element) 27. The first and second gear rims may have the same diameter/number of teeth, or the diameters/numbers of teeth of the two gear rims may be different.

The people conveyor 1 further comprises a brake 29 for braking the chain 12 of conveyance elements 13. In the embodiment depicted in FIG. 2, the brake 29 is integrated with the people conveyor drive 25 and configured for stopping the movement of the transmission element 27. In alternative configurations not depicted in the figures, the brake 29 may be configured for engaging with the sprocket 32 or with the conveyance chain 15.

A sensor 40 configured for detecting damage of the conveyance chain (first drive chain) 15 is arranged next to the conveyance chain 15, in particular in an area close to the sprocket 32.

Alternatively or additionally, a sensor 40 configured for detecting damage of the transmission element (second drive chain) 27 may be arranged next to the transmission element 27.

Figure 3:
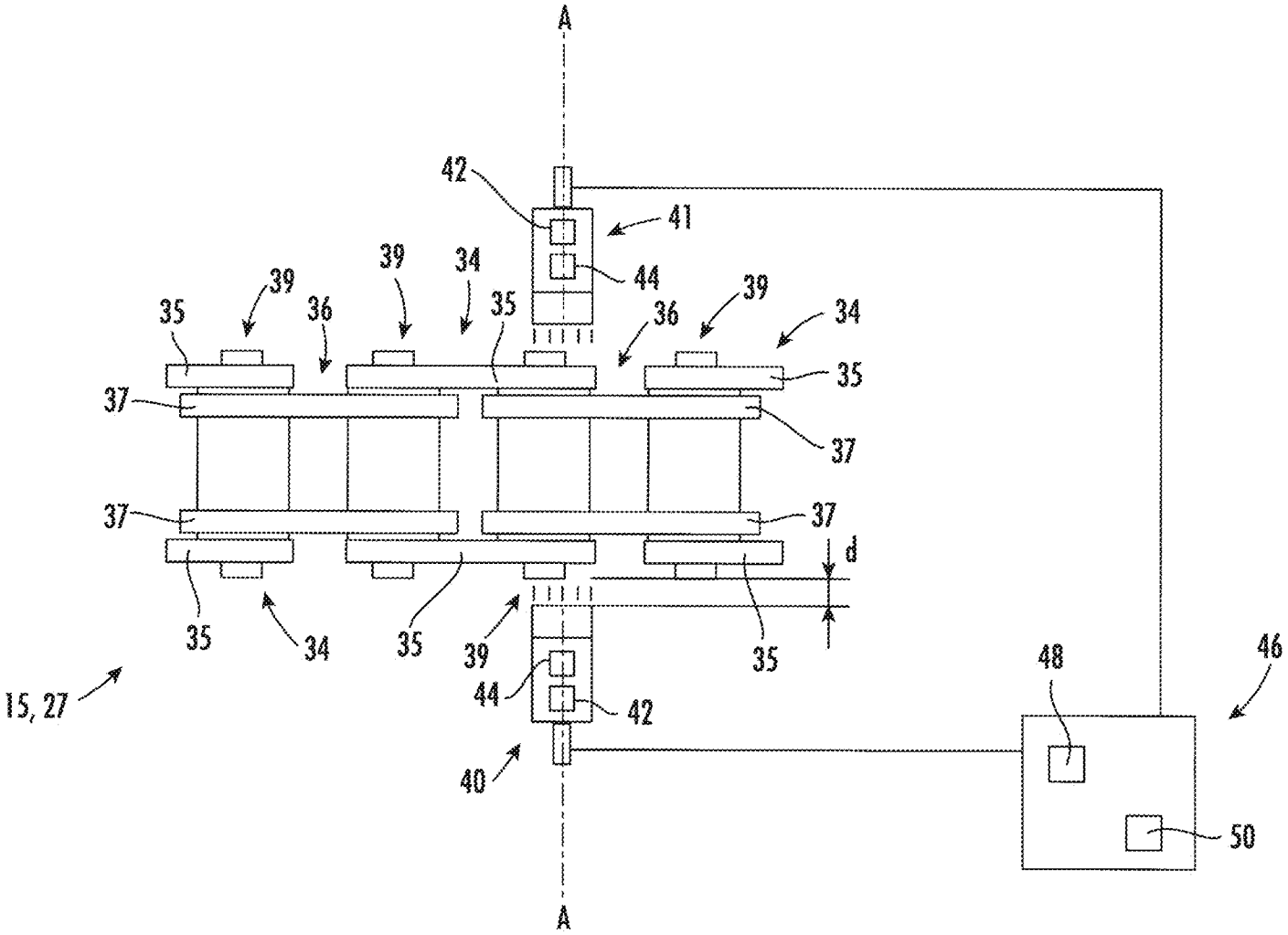
FIG. 3 depicts an enlarged top view of a portion of a drive chain with two sensors.

FIG. 3 depicts an enlarged top view of a portion of a drive chain 15, 27 and two sensors 40, 41 which are configured for detecting damage of the drive chain 15, 27.

The drive chain 15, 27 comprises a plurality of chain links 34, 36 including outer chain links 34 and inner chain links 36 alternately arranged next to each other in the conveyance direction. Each chain link 34, 36 comprises two link plates 35, 37 extending parallel to each other in the conveyance direction. The chain links 34, 36 are rotatably connected with each other by axles 39 extending orthogonally to the link plates 35, 37, i.e. extending orthogonally to the conveyance direction.

Over time, there is some risk that one of the chain link plates 35, 37 breaks while the people conveyor 1 is operated. In order to ensure safe operation of the people conveyor 1, it is desirable that a break of one of the link plates 35, 37 is detected early in order to allow stopping any further operation of the people conveyor 1 before the drive chain 15, 27 breaks completely.

According to an exemplary embodiment of the invention, at least one sensor 40, 41 is arranged laterally next to the drive chain 15, 27.

The at least one sensor 40, 41 is arranged in a spatial distance d with respect to the link plates 35 of the outer chain links 34 facing the at least one sensor 40, 41 and configured for providing a signal indicative of the status of the chain link plate 35, 37 passing by the respective sensor 40, 41. The spatial distance d is usually not larger than 5 cm; the spatial distance for example may be in the range of 2.5 cm to 5 cm.

In the embodiment depicted in FIG. 3, one sensor 40, 41 is arranged on each lateral side of the drive chain 15, 27, respectively. The two sensors 40, 41 are arranged opposite to each other. This, however, is only an exemplary configuration. The two sensors 40, 41 operate independently of each other. Thus, each sensor 40, 41 may be arranged at any location along the drive chain 15, 27 independently of the position of the other sensor 40, 41.

The sensors 40, 41 in particular may be arranged close to one of the landing portions 20, 21, in particular close to the sprocket 32. The sensor 40, 41 may be arranged in a distance of not more than 50 cm from the sprocket 32, i.e. from the position at which the drive chain 15, 27 contacts and engages with the sprocket 32. The sensor 40, 41 in particular may be arranged in a distance of not more than 25 cm from the sprocket 32, more particular in a distance of not more than 10 cm from the sprocket 32.

In operation, the drive chain 15, 27 usually oscillates with the chain links 34, 36 moving in a vertical direction which is orthogonal to the conveyance direction and orthogonal to axles 39 connecting the chain links 34, 36. Oscillation, inter alia, may be caused by the polygonal effect of the drive chain 15, 27 interacting with the sprocket 32. The drive chain 15, 27, however, is engaged with the sprocket 32 guiding the drive chain 15, 27. Thus, close to the sprocket(s) 32, the vertical amplitude of the oscillation, i.e. the variation of the position of the chain links 34, 36 in the vertical direction, is relatively small. In consequence, positioning the sensors 40, 41 close to the sprocket(s) 32 ensures that the chain links 34, 36 of the drive chain 15, 27 pass the sensors 40, 41 in a distance which is small enough for allowing the chain links 34, 36 being monitored by the sensors 40, 41 even when the drive chain 15, 27 is oscillating.

Each of the sensors 40, 41 in particular may be an inductive sensor comprising a permanent magnet 42 and an electric coil 44. A metallic element, such as a chain link plate 35, 37, passing by the sensor 40, 41 within the magnetic field of the permanent magnet 42 induces an inductive voltage within the coil 44. An axis A extending through the permanent magnet 42 and the electric coil 44 in particular may be oriented parallel to the axles 39 of the drive chain 15, 27.

Thus, when the link plates 35, 37 of the chain links 34, 36 of the drive chain 15, 27 pass the sensors 40, 41, a characteristic signal pattern (voltage pattern) is generated. Said signal pattern inter alia depends on the shape of the link plates 35, 37 and on the velocity of the chain links 34, 36 passing the sensor(s) 40, 41.

The signal pattern includes a series of periodic structures. The shape of said periodic structures is representative of the configuration of the chain links 34, 36.

The signal pattern changes when a damaged link plate 35, 37 passes the sensor(s) 40, 41 instead of an intact link plate 35, 37.

Each sensor 40, 41 is electrically connected with an evaluation unit 46. The evaluation unit 46 is configured for receiving a detection signal provided by the at least one sensor 40, 41, for example a detection signal representing the voltage induced within the coil 44 as a function of time. The evaluation unit 46 is further configured for evaluating the received detection signals in order to detect damage of the drive chain 15, 27, in particular damage of one of the link plates 35, 37.

In order to allow evaluating the received detection signals, the evaluation unit 46 may comprise a memory 48. At least one reference signal pattern representing an intact drive chain 15, 27, i.e. a drive chain 15, 27 comprising only intact (non damaged) chain links 35, 37 may be stored within said memory 48. The evaluation unit 46 may further comprise a comparison unit 50 configured for comparing the detection signals received from the at least one sensor 40, 41 with the at least one reference signal pattern stored within the memory 48.

The comparison unit 50 in particular may comprise a micro-processor and related circuitry. The micro-processor may be configured for running a program (software) in order to carry out the comparing procedure.

Damage of the drive chain 15, 27, such as a break of at least one of the link plates 35, 37, may be detected by calculating a difference between a detection signal received from the at least one inductive sensor 40, 41 and the at least one reference signal pattern, and by determining whether the calculated difference exceeds a predetermined threshold.

The detection signals received from the at least one inductive sensor 40, 41 and/or the at least one reference signal pattern stored within the memory 48 may be re-scaled as a function of the current velocity of the drive chain 15, 27 in order to allow the same reference signal pattern to be used for different velocities of the drive chain 15, 27.

The people conveyor 1 may comprise a velocity sensor (not shown) for determining the current velocity of the drive chain 15, 27. Alternatively, the current velocity of the drive chain 15, 27 may be determined from the received detection signals, e.g. from the frequency of the received detection signals.

In an alternative configuration, a plurality of signal patterns may be stored within the memory 48, each signal pattern corresponding to a predetermined velocity of the drive chain 15, 27, respectively.

The at least one signal pattern may be generated by performing a learning run. When a learning run is performed, the people conveyor 1 is operated with a drive chain 15, 27 which is known to be intact. The at least one sensor 40, 41 is operated monitoring the intact drive chain 15, 27, and the detection signals provided by the at least one sensor 40, 41 are stored as a reference signal pattern within the memory 48.

A plurality of learning runs with different velocities of the drive chain 15, 27 may be performed. Additionally or alternatively, reference signal patterns may be generated by averaging the signals received in a plurality of learning runs.

In yet another configuration, the evaluation of the received signals and the detection of damages of the drive chain 15, 27 may be based not on stored signal patterns but on a recognition of characteristic features in the received signals ("pattern recognition").

Figure 4:
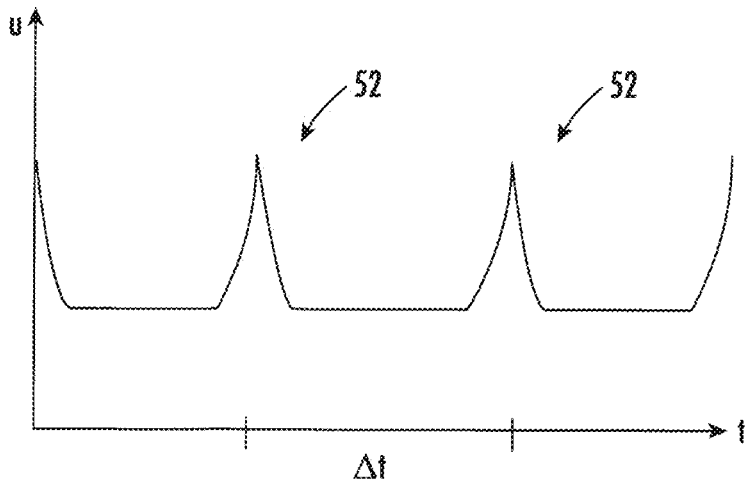
FIG. 4 depicts a signal pattern generated by an intact drive chain.
Figure 5:
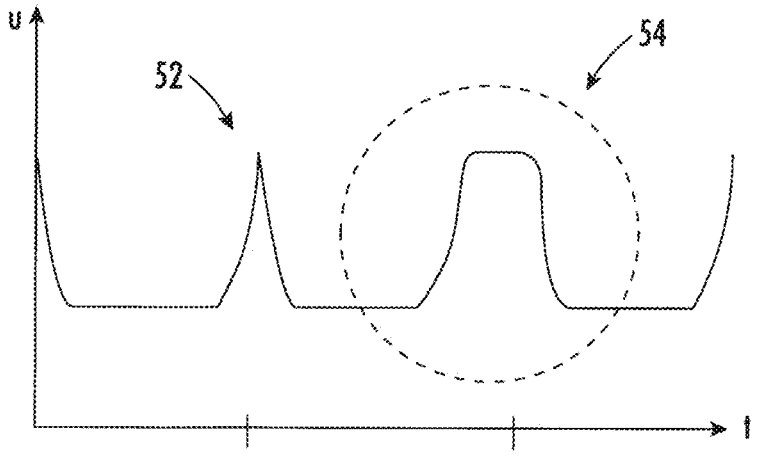
FIG. 5 depicts a signal pattern generated by a defect drive chain.

FIGS. 4 and 5 depict schematic examples of signals provided by the sensors 40, 41. In FIGS. 4 and 5, the voltage U induced within the coil 44 of the sensor 40, 41 is plotted on the y-axis as a function of time t, which is plotted on the x-axis.

FIG. 4 depicts a signal pattern as it is generated by an intact drive chain 15, 27, i.e. a drive chain 15, 27 in which all chain links 34, 36 and chain link plates 35, 37 are intact. Such an intact drive chain 15, 27 results in a regular signal pattern comprising a plurality of sharp peaks 52.

In the exemplary signal pattern shown in FIG. 4, the sharp peaks 52 correspond to the gap between the outer chain links 34 passing the sensor 40, 410. The distance between the link plate 37 of the inner chain links 36 and the sensors 40, 41 is larger than the distance d between the link plate 35 of the outer chain links 34 and the sensors 40, 41. Thus, the effect of the inner chain links 36 on the magnetic field of the permanent magnet 44 differs from the effect of the outer chain links 34. This difference results in the peaks 52 shown in FIG. 4.

When the velocity of the drive chain 15, 27 is constant, the temporal distance Δt between adjacent peaks 52 is constant as well. The temporal distance Δt between adjacent peaks 52 in particular corresponds to the moving velocity of the drive chain 15, 27. It therefore may be used for determining said moving velocity.

When the moving velocity of the drive chain 15, 27 is changed, the signal pattern shown in FIG. 4 may be adjusted by re-scaling, i.e. by expanding or compressing, the signal pattern along the x-axis in order to adjust for the changed moving velocity of the drive chain 15, 27.

An example of a signal pattern corresponding to a damaged drive chain 15, 27, i.e. a signal pattern generated by a drive chain 15, 27 in which at least one of the chain link plates 35, 37 is damaged/broken, is illustrated in FIG. 5.

Instead of sharp peaks 52, as generated by intact chain links 34, 36, a very different signal pattern (damage signal pattern) 54 is generated by the damaged chain link 34, 36.

Said damage signal pattern 54 may be recognized as indicating a damaged drive chain 15, 27 by pattern recognition or by comparison with the "ideal" signal pattern, as it is exemplary illustrated in FIG. 4.

The evaluation unit 46 may be configured for issuing an alarm signal when the evaluation of the received signals indicates that the drive chain 15, 27 is damaged, in particular that at least one of the link plates 35, 37 is broken.

The alarm signal may result in informing a technician about the detected damage so that the technician may visit the people conveyor 1 in order to check and repair the damaged drive chain 15, 27. Alternatively or additionally, the alarm signal may cause stopping any further operation of the people conveyor 1 in order to prevent additional damage or even severe safety issues which may result from operating the people conveyor 1 with a damaged drive chain 15, 27.

Stopping the operation of the people conveyor 1 may further include engaging a brake 29 of the people conveyor 1 in order to prevent any further movement of the band 12 of conveyance elements 13. Engaging a brake 29 in particular may be beneficial when the people conveyor 1 is an escalator 1*a* or an inclined moving walkway 1*b* in which the band 12 of conveyance elements 13 may be driven by gravity even after the active operation (driving) of the people conveyor drive 25 has been stopped.

Although only one drive chain 15, 27 is depicted in FIGS. 1 to 3, respectively, the skilled person will understand that the people conveyor 1 may comprise two drive chains 15, 27, in particular two drive chains 15, 27 extending parallel to each other. At least one inductive sensor 40, 41 may be arranged laterally next to each of the drive chains 15, 27 for monitoring the respective drive chain 15, 27.

While the invention has been described with reference to exemplary embodiments, it will be understood by those skilled in the art that various changes may be made and equivalents may be substituted for elements thereof without departing from the scope of the invention. In addition, many modifications may be made to adopt a particular situation or material to the teachings of the invention without departing from the essential scope thereof. Therefore, it is intended that the invention is not limited to the particular embodiments disclosed, but that the invention includes all embodiments falling within the scope of the claims.

REFERENCES

1 people conveyor
1*a* escalator
1*b* moving walkway
4 balustrade
6 moving handrail
12 band of conveyance elements
13 conveyance elements
13*a* steps
13*b* pallets
15 conveyance chain/first drive chain
16 conveyance portion
17 turnaround portion
18 return portion
20, 21 landing portions

22 guide rails
23 rollers
25 people conveyor drive
27 transmission element/second drive chain
29 brake
30 rotating shaft
32 sprocket
34 outer chain link
35 outer link plate
36 inner chain link
37 inner link plate
39 axle
40 sensor
41 sensor
42 magnet
44 coil
46 evaluation unit
48 memory
50 comparison unit
52 peak
54 damage signal pattern
d spatial distance
Δt temporal distance
t time
U inductive voltage

What is claimed is:

1. A people conveyor comprising:

a band of conveyance elements extending in a conveyance direction and driven by at least one drive chain comprising a plurality of chain links; and at least one inductive sensor arranged laterally to the at least one drive chain and configured for monitoring the chain links passing by the at least one inductive sensor;

wherein the plurality of chain links each include an inner chain link having an inner link plate and an outer chain link having an outer link plate, a distance between each inner link plate and the at least one inductive sensor being larger than a distance between each outer link plate and the at least one inductive sensor;

the at least one inductive sensor arranged laterally to the outer link plate and the inner link plate.

2. The people conveyor according to claim 1, wherein the at least one drive chain includes a conveyance chain connected to the conveyance elements and extending in the conveyance direction.

3. The people conveyor according to claim 1, wherein the at least drive chain includes a transmission element extending between a people conveyor drive and a sprocket, and being configured for driving the band of conveyance elements.

4. The people conveyor according to claim 1 comprising at least two inductive sensors, wherein at least one inductive sensor is arranged on each lateral side of the drive chain.

5. The people conveyor according to claim 4, wherein two inductive sensors are arranged opposite to each other with the drive chain extending in between the two inductive sensors.

6. The people conveyor according to claim 1, wherein the drive chain extends over at least one sprocket, and wherein the at least one inductive sensor is arranged in the vicinity of said sprocket.

7. The people conveyor according to claim 6, wherein the at least one inductive sensor is arranged in a distance of not more than 50 cm from the sprocket, in particular in a distance of not more than 25 cm from the sprocket, more particular in a distance of not more than 10 cm from the sprocket.

8. The people conveyor according to claim 1, further comprising an evaluation unit configured for receiving and evaluating the detection signals provided by the at least one inductive sensor for detecting defects of the chain links.

9. The people conveyor according to claim 8, wherein the evaluation unit comprises a memory for storing at least one signal pattern representing non-defective chain links, and wherein the evaluation unit is configured for comparing the detection signals received from the at least one inductive sensor with the at least one stored signal pattern.

10. The people conveyor according to claim 9, wherein the evaluation unit is configured for issuing an alarm signal, when the difference between a detection signals received from the at least one inductive sensor and the at least one stored signal pattern exceeds a predetermined first threshold.

11. The people conveyor according to claim 9, wherein the evaluation unit is configured for stopping the people conveyor, in particular for triggering a brake, when the difference between the detection signals received from the at least one inductive sensor and the at least one stored signal pattern exceeds a predetermined second threshold.

12. The people conveyor according to claim 9, wherein the evaluation unit is configured for performing a learning run in which the detection signals received from the at least one inductive sensor are stored as reference signal patterns representing non-defective chain links within the memory.

13. The people conveyor according to claim 1, wherein the people conveyor is an escalator comprising a plurality of steps or a moving walkway comprising a plurality of pallets.

14. Method of operating a people conveyor according to claim 1, wherein the method includes monitoring the chain links by means of the at least one inductive sensor, evaluating the detection signals provided by the at least one inductive sensor and issuing an alarm signal when a defect of the drive chain is detected, wherein evaluating the detection signals in particular includes comparing the detection signals provided by the at least one inductive sensor with at least one predetermined reference signal pattern.

15. Method of operating a people conveyor according to claim 14, wherein the method includes stopping operating the people conveyor when a defect of the drive chain is detected; wherein the method particularly includes engaging a brake for stopping any movement of the conveyance elements when a defect of the drive chain is detected.

16. A people conveyor comprising:

a band of conveyance elements extending in a conveyance direction and driven by at least one drive chain comprising a plurality of chain links; and at least one inductive sensor arranged laterally to the at least one drive chain and configured for monitoring the chain links passing by the at least one inductive sensor;

wherein the plurality of chain links each include an inner chain link having an inner link plate and an outer chain link having an outer link plate, a distance between each outer link plate and the at least one inductive sensor being larger than a distance between each inner link plate and the at least one inductive sensor;

the at least one inductive sensor arranged laterally to the outer link plate and the inner link plate.

* * * * *